US005096314A

United States Patent [19]

Komori et al.

[11] Patent Number: 5,096,314

[45] Date of Patent: Mar. 17, 1992

[54] THERMAL LINE PRINTER

[75] Inventors: Masayoshi Komori; Toshio Tanaka, both of Hirakata; Satoshi Yamaura, Osaka; Kenji Nakasono, Hirakata, all of Japan

[73] Assignee: Matsushita Electric Industrial Co., Ltd., Osaka, Japan

[21] Appl. No.: 666,646

[22] Filed: Mar. 8, 1991

[30] Foreign Application Priority Data

Mar. 14, 1990 [JP] Japan ..... 2-063181

[51] Int. Cl.[5] ..... B41J 1/56

[52] U.S. Cl. ..... 400/175; 400/120

[58] Field of Search ..... 101/93.04, 93.08; 400/120, 175; 346/76 PH

[56] References Cited

U.S. PATENT DOCUMENTS

| | | | |
|---|---|---|---|
| 4,170,422 | 10/1979 | Bilek | 400/120 |
| 4,235,555 | 11/1980 | Aprato | 346/76 PH |
| 4,507,666 | 3/1985 | Kondo et al. | 400/120 |
| 4,710,040 | 12/1987 | Grey | 346/76 PH |
| 5,005,026 | 4/1991 | Sakai | 400/120 |
| 5,014,073 | 5/1991 | Sone et al. | 346/76 PH |

FOREIGN PATENT DOCUMENTS

| | | | |
|---|---|---|---|
| 0311981 | 4/1989 | European Pat. Off. . | |
| 0311982 | 4/1989 | European Pat. Off. . | |
| 2341181 | 3/1974 | Fed. Rep. of Germany . | |
| 176076 | 10/1984 | Japan | 400/120 |
| 151081 | 8/1985 | Japan | 400/120 |
| 164572 | 7/1987 | Japan | 400/120 |
| 59572 | 3/1988 | Japan | 400/120 |

*Primary Examiner*—David A. Wiecking
*Assistant Examiner*—Ren Yan
*Attorney, Agent, or Firm*—Stevens, Davis, Miller & Mosher

[57] ABSTRACT

A thermal line printer usable as a small output terminal. A printer body has a platen roller rotatably supported by a casing having side plates on either side thereof. A line-printing type thermal head is swingably supported by the printer body while being resiliently urged toward the platen roller. This arrangement allows the thermal head to be easily mounted on and dismounted from the printer body.

4 Claims, 6 Drawing Sheets

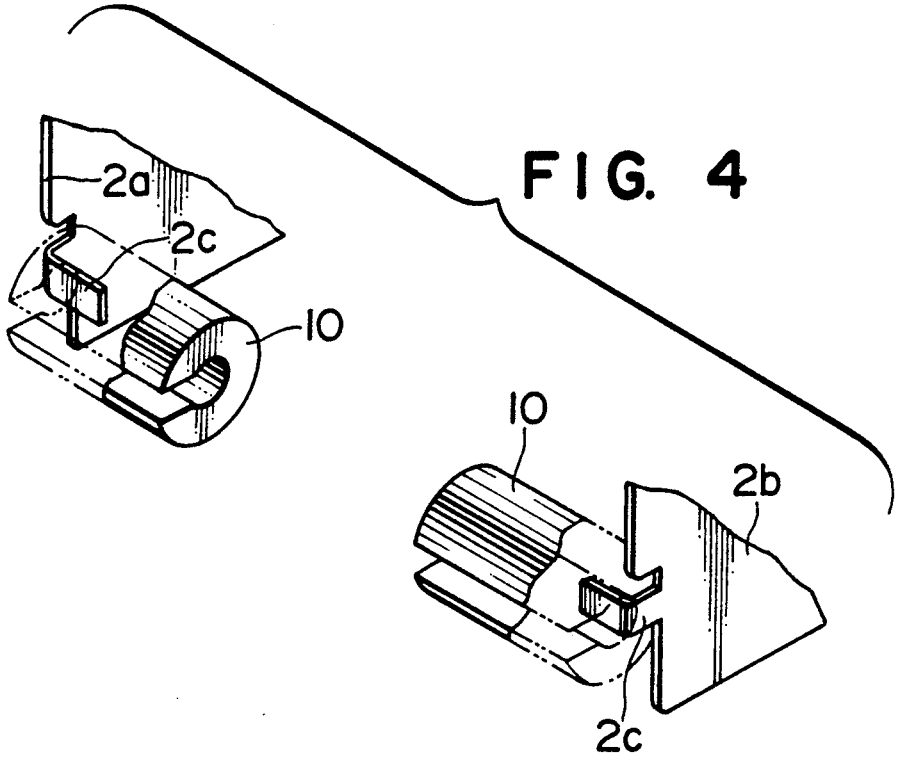
FIG. 4
FIG. 5
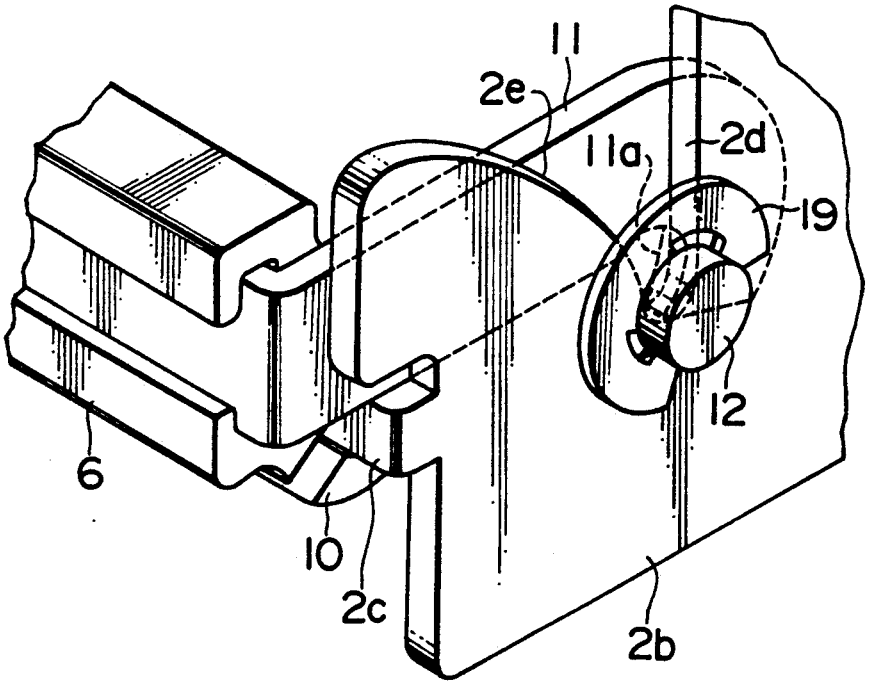

THERMAL LINE PRINTER

BACKGROUND OF THE INVENTION

1. Field of the Invention

The present invention relates to a thermal line printer usable as a small piece of output terminal equipment.

2. Description of the Related Art

A conventional thermal line printer has a platen roller and a thermal head, between which recording paper is set so that the thermal head can perform printing on the recording paper while the platen roller is rotated by a motor. A head section comprises the thermal head and a head support supporting the head, which are supported onto the printer body by a common shaft. The head support is fixed to the printer body by machine screws.

When, however, the head support as well as the thermal head must be dismounted in order to perform a maintenance operation, etc., it is necessary that the shaft be dismounted from the printer body. Unscrewing the machine screws fixing the head support requires the use of tools specially fit for this purpose, and involves the risk of losing some of the screws.

SUMMARY OF THE INVENTION

In order to overcome the above-described problem, the present invention is directed to providing a thermal line printer having a thermal head which can be easily dismounted from the printer body, and can also be correctly positioned.

In order to achieve said object, according to the present invention, there is provided a thermal line printer comprising: a printer body having a casing with side plates on either side thereof, and a platen roller disposed in the casing and rotatably supported by bearings on the side plates; a drive section for rotating the platen roller; a head support having bearing portions at the rear end thereof, the bearing portions being supported by the side plates of the printer body for the swinging of the head support; and a line-printing type thermal head having a shaft at the rear end thereof, the shaft being supported on the sides corresponding to the bearing portions of the head support for the rotation of the thermal head, the thermal head also having a front end portion engageable with a front end portion of the head support, the thermal head being resiliently urged toward the platen roller; the side plates of the printer body having position-determining grooves at positions corresponding to the shaft of the thermal head, the shaft by which the thermal head is supported for rotation being capable of fitting into the grooves.

According to the present invention, the thermal head can be easily dismounted from the printer body. Further, since the shaft, by which the thermal head is supported for rotation, is capable of fitting into the position-determining grooves formed in the side plates, the set interval between the position-determining grooves and the bearings on the side plates, by which the platen roller is rotatably supported, allows the thermal head to assume a positional relation with the platen roller which is exactly the same as the predetermined one. This feature enables the thermal head to be correctly positioned even when it has been dismounted from the printer body and then mounted again.

BRIEF DESCRIPTION OF THE DRAWINGS

FIGS. 4 is a perspective view of side plates of the printer as well as bearing portions of a head support of the printer;

FIG. 5 is an enlarged perspective view of one of the side plates and one of the bearing portions, shown together with the associated parts;

DESCRIPTION OF THE PREFERRED EMBODIMENT

One embodiment of the present invention will now be described with reference to FIGS. 1 to 7.

Figure 1:
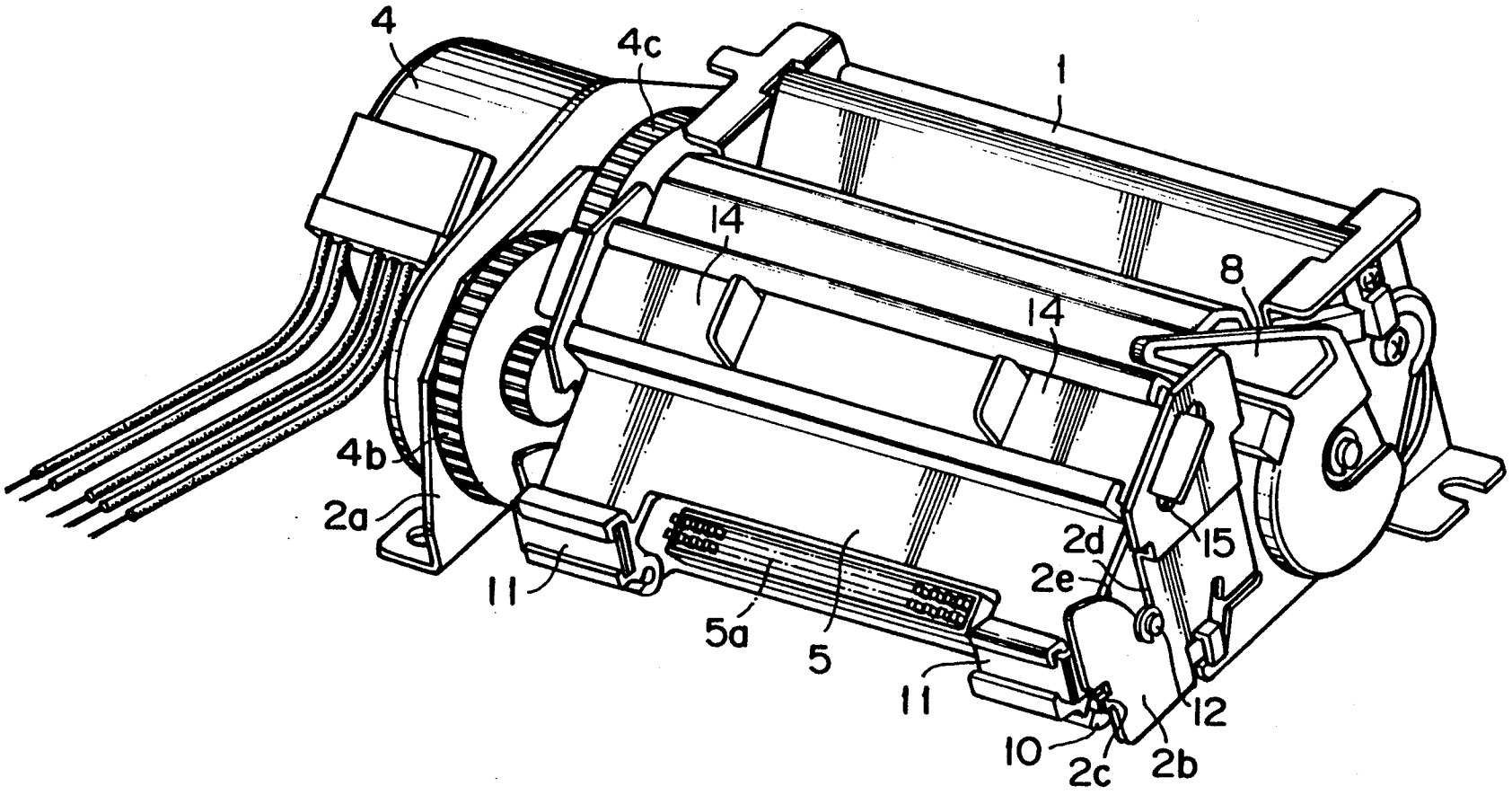
FIG. 1 is a perspective view of a thermal line printer according to one embodiment of the present invention.
Figure 2:
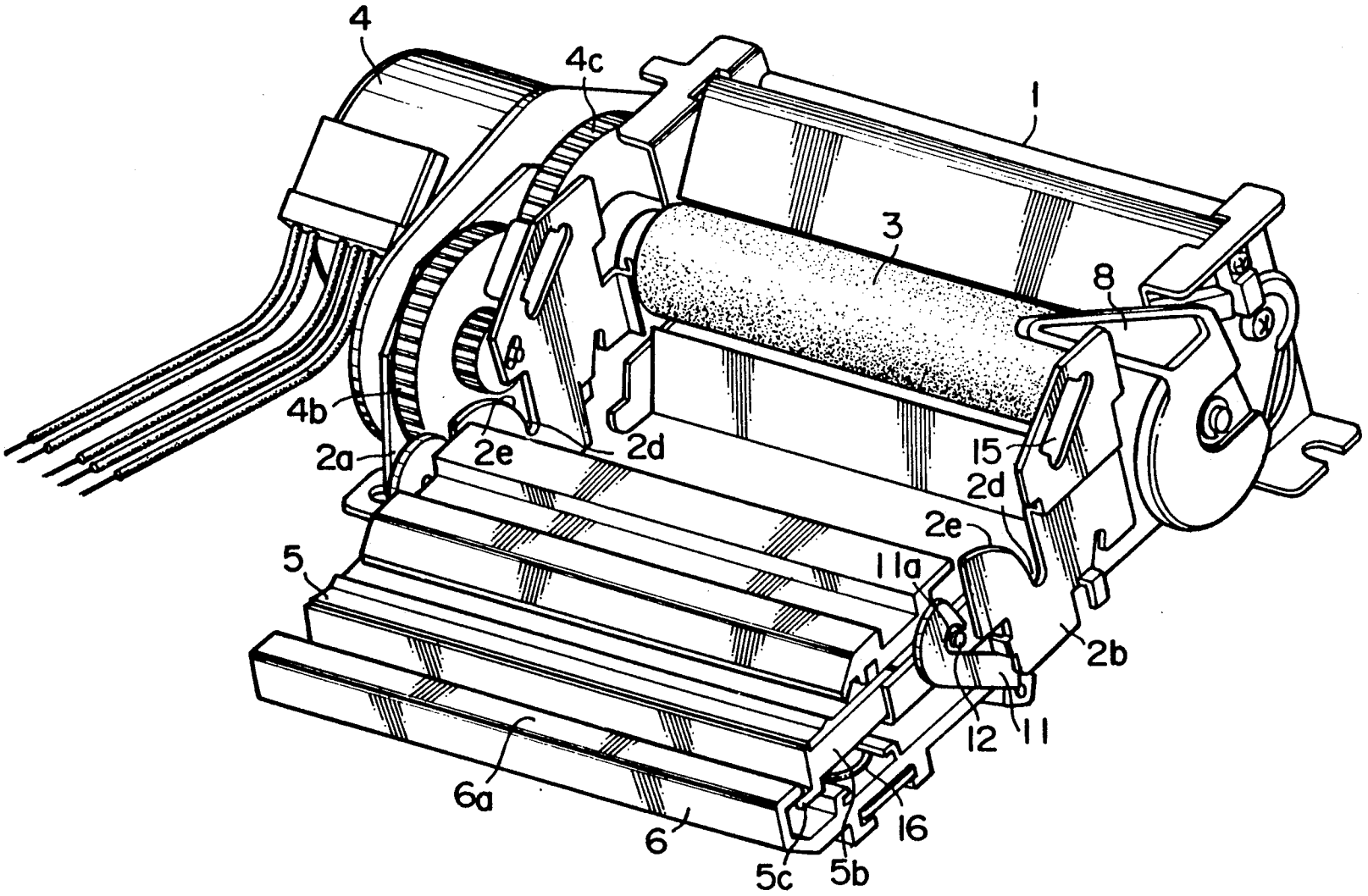
FIG. 2 is a perspective view of the printer, shown with its head section opened.
Figure 3:
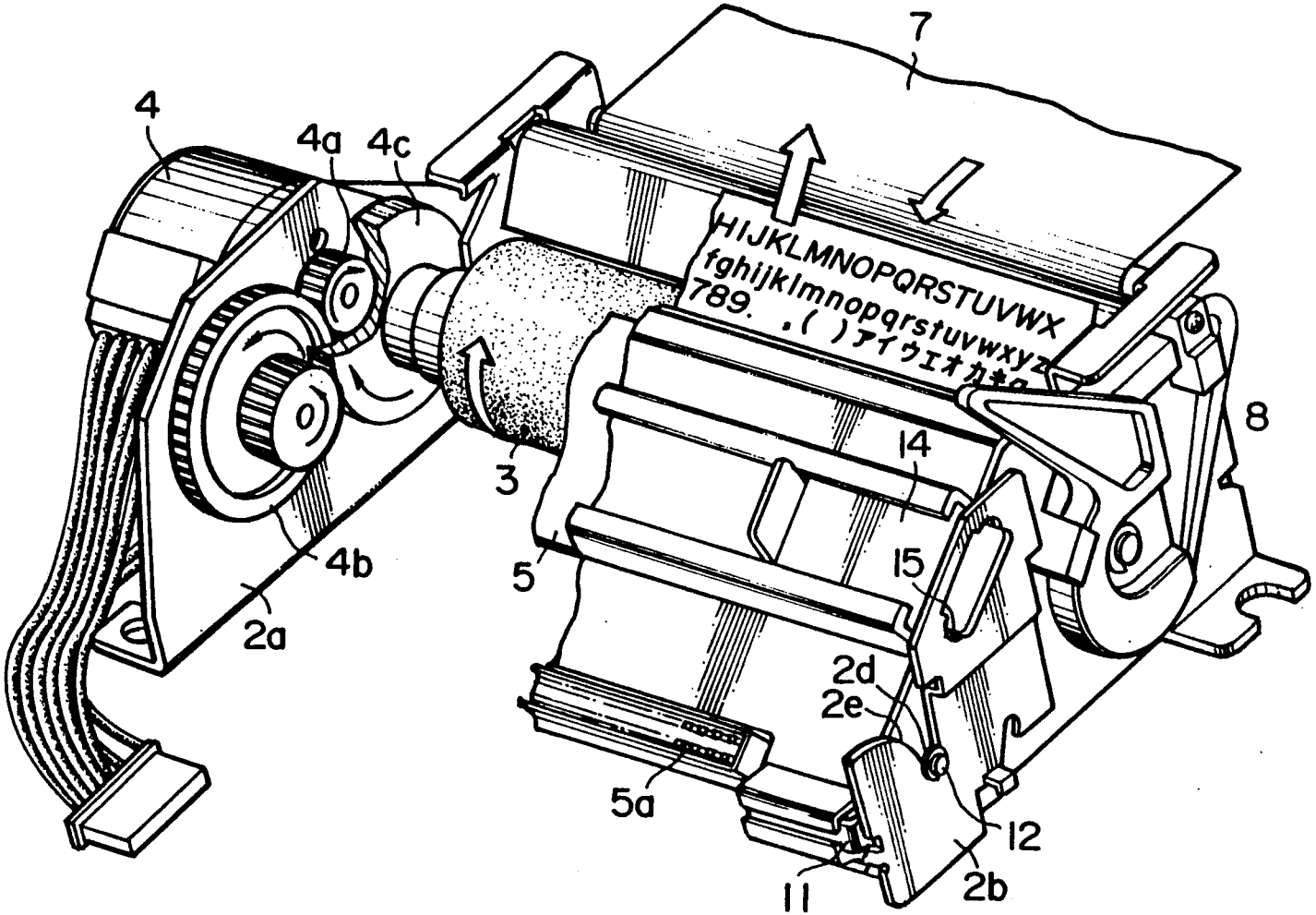
FIG. 3 is a partially cut-away, perspective view of the printer in operation.

Referring to FIGS. 1 to 3, a thermal line printer embodying the present invention includes a casing 1 having side plates 2*a* and 2*b* on either side thereof. A platen roller 3 having a surface made of rubber is disposed in the casing 1 while rotatably supported by bearings on the side plates 2*a* and 2*b*. A printer body is mainly constituted by the members 1, 2*a*, 2*b* and 3.

Disposed on the side of the side plate 2*a* are a motor 4 having a rotary shaft with a motor pinion gear 4*a* mounted thereon, and an idler gear 4*b* in meshing engagement with the motor pinion gear 4*a* and a platen roller gear 4*c* mounted on the shaft of the platen roller 3. The above-described members constitute a paper feed driving section. The rotation of the motor 4 is first transmitted to the motor pinion gear 4*a*, then to the idler gear 4*b* which comprises a large-diameter gear element in meshing engagement with the pinion gear 4*a* and a small-diameter gear element integral therewith, whereupon the speed of the rotation is reduced. Further, the rotation is transmitted to the platen roller gear 4*c*, thereby causing the platen roller 3 to rotate.

A line-printing type thermal head 5 extends along the platen roller 3. The thermal head 5, which is composed of a plurality of heating elements arranged in a line on a substrate secured to a metal base plate 5*b*, is disposed between the side plates 2*a* and 2*b* while supported by a head support 6 made of a metal material, the members 5 and 6 constituting the head section of the printer. Printing is performed by causing the platen roller 3 to be rotated by the motor 4 after recording paper 7 is set in the gap between the thermal head 5 and the platen roller 3. The thermal head 5 receives a printing signal input through a head connector 5*a*. The thermal head 5 is pressed toward the platen roller 3 only when printing is performed, and the head 5 can be moved toward and away from the platen roller 3 by operating a release arm 8.

The head section of the printer according to the present invention will be described in detail. As shown in FIGS. 4 and 5, each of the side plates 2*a* and 2*b* has an L-shaped projection 2*c*. The head support 6 has bearing portions 10, each having a C-shaped section and a cylindrical shape with a slit axially extending in a part of the cylinder. The projections 2*c* are fitted into the bearing portions 10 so that the head support 6 is swingable about the projections 2c. Further, L-shaped, shaft-holding plates 11 have one of their respective ends mounted on either side of the head support 6. Each of the shaft-holding plates 11 has a recess 11a at the other end, and the recesses 11a allow a shaft 12 of the thermal head 5 (described below) to be fitted there-through. Still further, each of the side plates 2a and 2b has determining groove 2d for permitting the head section to be disposed in the casing 1 at a correctly determined position. The groove 2d has a smooth round portion 2e. The shaft 12 is provided at the rear end of the thermal head 5, and supports the thermal head 5 for its rotation. The two ends of the shaft 12 are fitted through the recesses 11a of the shaft-holding plates 11 on either side of the head support 6 and, while this engagement is maintained, the end portions of the shaft 12 are guided by the round portions 2e of the position-determining grooves 2d to fit right onto the respective bottoms of the grooves 2d. Thus, the head section is arranged to be mounted onto the casing 1 with its position correctly determined. As best shown in FIG. 5, two E-rings 19 are provided on either end of the shaft 12 so as to prevent disengagement of the shaft 12 from the grooves 2d.

As shown in FIG. 2, a spring 16 for urging the thermal head 5 toward the platen roller 3 is interposed between the thermal head 5 and the head support 6. The resilience of the spring 16 allows the thermal head 5 to be supported by the head support 6 in its state of being resiliently urged toward the platen roller 3. Specifically, the head support 6 has a substantially L-shaped stopper 6a at the front end thereof, and the thermal head 5 has a substantially L-shaped protrusion 5c at the front end of the base plate 5b. When, as shown in FIG. 6, the protrusion 5c engages with the stopper 6a, the thermal head 5 is supported by the head support 6 while being urged forward by the spring 16 from the back side of the base plate 5b.

Thus, the printer according to the present invention has the head support 6 swingable about the axis of the bearing portions 10 and the projections 2c of the side plates 2a and 2b. Therefore, the head section can be swung from the closed position shown in FIG. 1 (in which the printer is usable) to the open position shown in FIG. 2.

Figure 7:
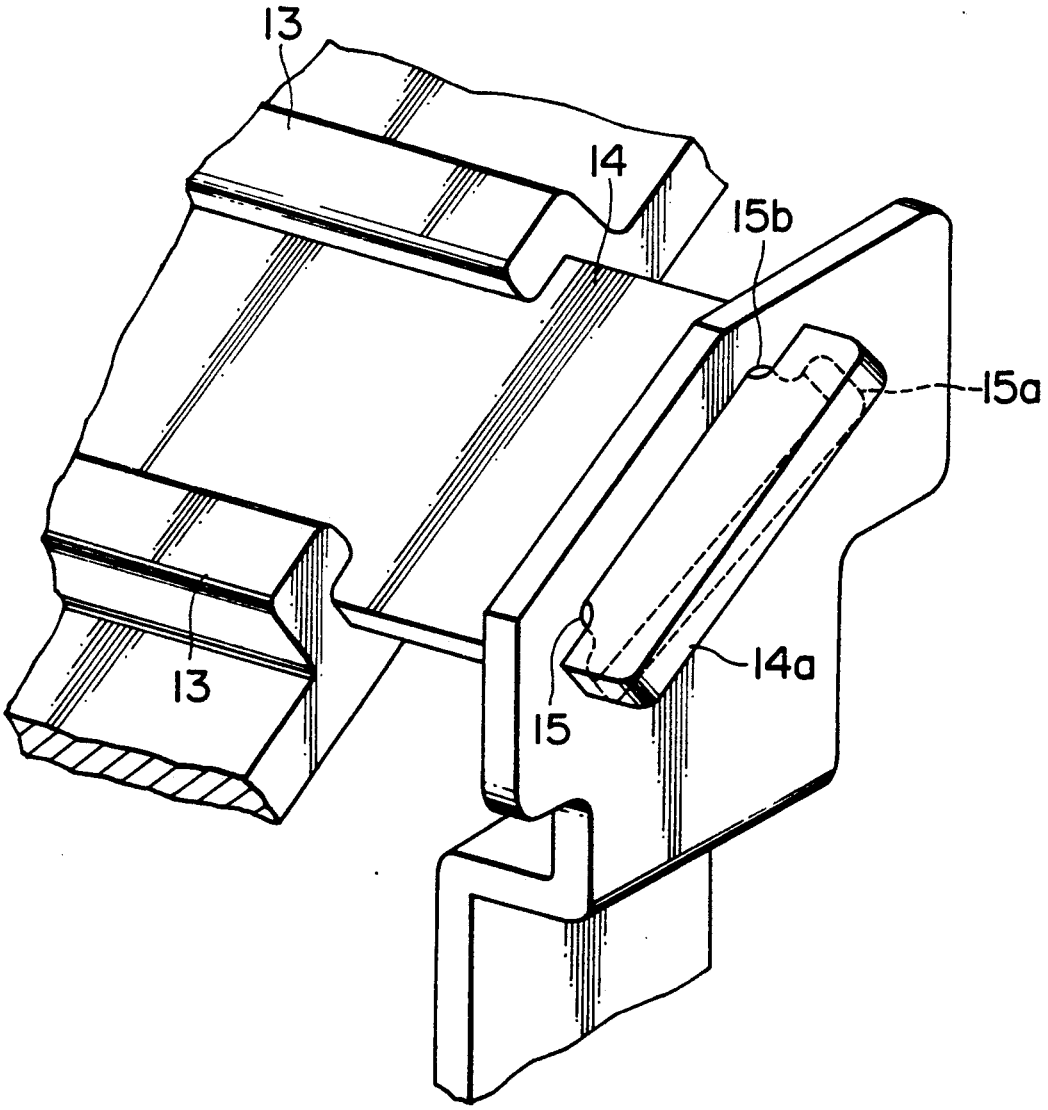
FIG. 7 is an enlarged perspective view of a stopper plate of the printer, shown in its state of being locked onto one of the side plates.

As shown in FIG. 7, a pair of rails 13 are provided on the upper surface of the head support 6, and two substantially L-shaped stopper plates 14 are slidably fitted in the gap between the rails 13. The side plates 2a and 2b have engagement portions 15 each with an opening. When the plates 14 are slid toward the side plates 2a and 2b, and the respective ends of the plates 14 are passed through the openings of the engagement portions 15 of the side plates 2a and 2b and then engaged with and locked onto the portions 15, the head section can be held in a fixed position. Specifically, each engagement portion 15 has an opening comprising an elongated hole 15a wider than the stopper plates 14, and an engagement hole 15b. Each stopper plate 14 has a notched end portion 14a which is first passed through the elongated hole 15a, then brought into engagement with the engagement hole 15b, so that the engagement of the plates 14 allows the printer section to be held in place. Because the stopper plates 14 are urged upward by the resilience of the spring 16 interposed between the head support 6 and the thermal head 5, the plates 14 have arrangements for preventing their unwanted disengagement from the engagement holes 15b.

Figure 6:
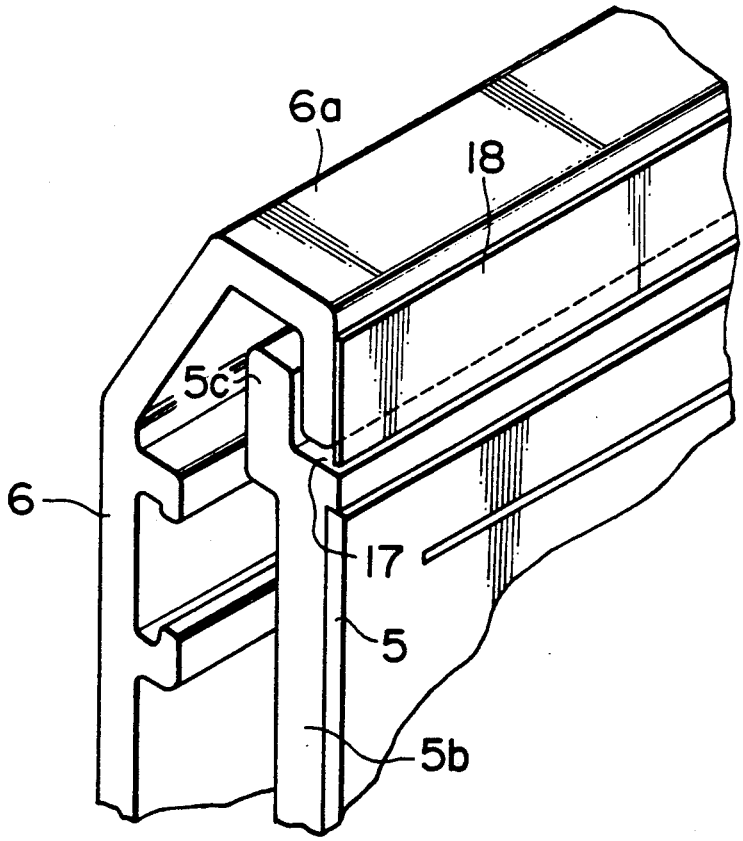
FIG. 6 is an enlarged perspective view of the front end portion of the head section of the printer.

As shown in FIG. 6, a belt-shaped guide sheet 18 is provided at the front end portion of the head section in such a manner as to cover the gap 17 between the protrusion 5c of the thermal head 5 and the stopper 6a of the head support 6.

With the above-described construction, when the shaft 12 mounted on the thermal head 5 is fitted into the position-determining grooves 2d of the side plates 2a and 2b of the casing 1, the thermal head 5 can be brought into the correct position relative to the platen roller 3.

The operation of the thermal line printer according to this embodiment will be described. When printing is to be performed, the release arm 8 is pulled toward the operator to move the thermal head 5 away from the platen roller 3. Recording paper 7 is inserted into the gap between the head 5 and the roller 3, and set as shown in FIG. 3. Then, the release arm 8 is pushed away from the operator to move the thermal head 5 toward the platen roller 3 until the head 5 is pressed on the platen roller 3 with the paper 7 therebetween. When the motor 4 is started, the platen roller 3 is rotated to effect paper feed. The thermal head 5 is supplied with a printing signal through the head connector 5a so as to perform printing on the recording paper 7.

When the thermal head 5 is to be replaced during a maintenance operation, etc., the notched end portions 14a of the stopper plates 14 are disengaged from the engagement portions 15, and the plates 14 are slid away from the side plates 2a and 2b. Then, the shaft 12 which is fitted in the position-determining grooves 2d is disengaged therefrom and, while the shaft 12 is held in the recesses 11a of the shaft-holding plates 11, the head section is swung open into the position shown in FIG. 2. In this condition, the thermal head 5 to be replaced is removed from the head support 6. Thus, according to the present invention, the thermal head can be easily dismounted from the printer body.

When the new head 5 is mounted on the printer body, the thermal head 5 is brought into the correct position in relation to the platen roller 3 by virtue of the set interval between the bearings on the side plates 2a and 2b which rotatably support the platen roller 3 and the position-determining grooves 2d which support the end portions of the shaft 12. Since the shaft, by which the thermal head is supported for its rotation, can fit into the position determining grooves, when the end portions of the shaft 12 are completely received in these grooves separated by a set interval from the bearing portions of the platen roller, the thermal head assumes the predetermined positional relation with the platen roller. Thus, according to the present invention, the thermal head can be correctly positioned even when the head has been dismounted and then mounted again.

What is claimed is:

1. A thermal line printer comprising: a printer body having a casing with a side plate on each side thereof, said side plates having bearings disposed thereon and a platen roller disposed in said casing and rotatably supported by said bearings; a drive section for rotating said platen roller; a head support having bearing portions at a rear end thereof and a front end portion, said bearing portions being supported by said side plates of said printer body for the swinging of said head support; and a line-printing type thermal head having a shaft at a rear end thereof, said shaft being supported on the side plates adjacent to said bearing portions of said head support for the rotation of said thermal head, said thermal head also having a front end portion in removable engagement with said front end portion of said head support, means resiliently urging said thermal head toward said platen roller; said side plates of said printer body having position-determining grooves at positions corresponding to said shaft of said thermal head, said shaft of said thermal head being positioned in a predetermined desired position as said shaft is moved into said grooves to thereby position said thermal head in the proper position for printing.

2. A thermal line printer according to claim 1, wherein said head support includes a pair of rails on an upper surface thereof and having a gap therebetween, two stopper plates slidably fitted in said gap, each of said stopper plates having an end portion, and wherein said side plates of said printer body include engagement portions each having an opening comprising an elongated hole wider than said stopper plates, and an engagement hole with which said respective end portions of said stopper plates are engageable, said head support being held at a fixed position relative to said printer body by passing said end portions of said stopper plates through said elongated holes, and then bringing said end portions into engagement with said engagement holes.

3. A thermal line printer according to claim 1, further comprising a guide sheet and a gap between said front end portion of said head support and said front end portion of said thermal head, said guide sheet being disposed to cover said gap.

4. A thermal line printer according to claim 1, wherein said side plates of said printer body include projections, and wherein each of said bearing portions of said head support comprises a cylindrical portion having a C-shaped section and a slit extending in a part of said cylindrical portion, said projections of said side plates being fitted into said bearing portions of said head support to swingably support said head support.

* * * * *